US006198448B1

(12) United States Patent
Suzuki et al.

(10) Patent No.: US 6,198,448 B1
(45) Date of Patent: Mar. 6, 2001

(54) LIGHTWEIGHT ANTENNA ASSEMBLY COMPRISING A WHIP ANTENNA AND A HELICAL ANTENNA MOUNTED ON A TOP END OF THE WHIP ANTENNA

(75) Inventors: Fumihiro Suzuki; Kazuo Minegishi, both of Sendai (JP)

(73) Assignee: Tokin Corporation, Miyagi (JP)

( * ) Notice: Subject to any disclaimer, the term of this patent is extended or adjusted under 35 U.S.C. 154(b) by 0 days.

(21) Appl. No.: 09/123,209

(22) Filed: Jul. 27, 1998

(30) Foreign Application Priority Data

Jul. 29, 1997 (JP) ..... 9-203148
Jul. 31, 1997 (JP) ..... 9-206299
Dec. 17, 1997 (JP) ..... 9-347918

(51) Int. Cl.[7] ..... H01Q 21/00
(52) U.S. Cl. ..... 343/725; 343/895; 343/900
(58) Field of Search ..... 343/702, 895, 343/900, 725, 904, 715; H01Q 21/00, 1/36, 9/30

(56) References Cited

U.S. PATENT DOCUMENTS 5,177,492 1/1993 Tomura et al. .
5,204,687 4/1993 Elliott et al. .
5,243,355 9/1993 Emmert et al. .
5,412,393 5/1995 Wiggenhorn .
5,583,519 12/1996 Koike .

FOREIGN PATENT DOCUMENTS 0 467 822 A2 1/1992 (EP) .
0 722 195 A1 7/1996 (EP) .
0 764 998 A1 3/1997 (EP) .
2 257 836 1/1993 (GB) .
3-245603 11/1991 (JP) .
5-243829 9/1993 (JP) .
2646505 5/1997 (JP) .

*Primary Examiner*—Tho Phan
(74) *Attorney, Agent, or Firm*—Frishauf, Holtz, Goodman, Langer & Chick, P.C.

(57) ABSTRACT

In an antenna assembly (10) including a whip antenna (1, 9) provided with a stopper (5) of a conductive material at a lower end of the whip antenna, a helical antenna (2) provided with a conductive sleeve (6) mounted on a top end of the whip antenna, and a holder (4) of a conductive material for slidably holding the whip antenna, each of the stopper, the conductive sleeve, and the holder is of a light metal having a specific gravity not greater than 3 g/cm$^3$. The holder is electrically connected to the stopper when the whip antenna is in an extended position. The holder is electrically connected to the conductive sleeve when the whip antenna is in a retracted position. The light metal may includes at least one of aluminum and magnesium. Alternatively, the light metal essentially consists of 0.4% or less Si, 0.7% or less Fe, 5.0–6.0% Cu, 0.30% or less Zn, 0.2–0.6% Bi, 0.2–0.6% Pb, and the balance Al in weight.

18 Claims, 10 Drawing Sheets

LIGHTWEIGHT ANTENNA ASSEMBLY COMPRISING A WHIP ANTENNA AND A HELICAL ANTENNA MOUNTED ON A TOP END OF THE WHIP ANTENNA

BACKGROUND OF THE INVENTION

This invention relates to an antenna assembly comprising a whip antenna and a helical antenna mounted on a top end of the whip antenna.

An antenna assembly of the type described has been used in a radio communication device such as a portable communication terminal set, especially a mobile telephone terminal set. The antenna assembly is usually extendably and retractably mounted to a housing (or a casing) of the terminal set as disclosed in JP-A-3 245603 (Reference I).

In Reference I, the terminal set has a housing or enclosure enclosing transmitting and receiving electrical circuitry. The antenna assembly comprises the whip antenna (or an antenna rod) and a holder (or a support) attached to the housing for slidably holding (or supporting) the whip antenna. The holder (or the support) is made of a conductor and is connected to the electrical circuitry. The whip antenna is provided with a stopper (or a conductive ring) fixedly mounted on a lower or an inner end. When the whip antenna is in an extended position, the stopper is brought into contact with the holder (or the support) so that the whip antenna is connected to the electrical circuitry through the stopper and the holder (or the support). The whip antenna comprises a conductive rod covered with a dielectric sleeve or tube. The whip antenna or the conductive rod has an electrical length of a quarter wavelength of a predetermined frequency.

The helical antenna (or an antenna coil) is enclosed in a dielectric cap and is carried on a top end of the whip antenna. The dielectric cap is provided with a conductive sleeve at a lower end electrically connected to the helical antenna. The conductive sleeve is fitted onto the top end of the whip antenna and fixed thereto by caulking or deforming the conducive sleeve together with the dielectric sleeve of the whip antenna. The helical antenna is connected to the conductive rod of the whip antenna and has also an electrical length of a quarter wavelength of the predetermined frequency. Therefore, the antenna assembly has a half wavelength of the predetermined frequency.

When the antenna assembly is in a retracted position where the whip antenna is retracted in the housing, the helical antenna is connected to the electrical circuitry through the conductive sleeve and the holder (or the support). Thus, the helical antenna is used for short-range operation of the terminal set. At the retracted position, the whip antenna is in the housing and, therefore, does not serve for receiving the radio signal.

For a long-range operation, the antenna assembly is pulled out by manually handling the cap into the extended position where the stopper is brought into contact with the holder (or the support). Thus, the antenna assembly serves as a half-wavelength antenna. This structure of the antenna assembly will be referred to as a "non-separate type" because the whip antenna is not electrically separated from the helical antenna.

An assembly of the helical antenna and the dielectric cap with the conductive sleeve will be referred to as an antenna top.

Use is made of a special support of a coaxial structure as the holder (or the support) in order to insure that the whip antenna is disabled when the antenna assembly is in the retracted position. This is disclosed in GB 2,257,836 A (Reference II) and JP-A-5 243829 corresponding thereto.

In U.S. Pat. No. 5,204,687 (Reference III) and JP-B-2646505 (Reference IV), another structure of the antenna assembly is disclosed in which the conductor rod of the whip antenna is not electrically connected to the helical antenna but is insulated from the helical antenna. In the structure, the whip antenna is reliably disabled in the retracted position without use of the special support of the coaxial structure. The whip antenna only serves for receiving the radio signal in the extended position because the helical antenna is no longer connected to the holder (or the support). This structure of the antenna assembly will be referred to as a "separate type" because the whip antenna is electrically separated from the helical antenna.

In detail, Reference IV discloses a dielectric joint member of a generally rod shape which is secured at one end thereof to the top end of the conductor rod of the whip antenna. The dielectric joint member is partially covered with the conductive sleeve and is fitted at the other end portion with a coil bobbin. A helical coil or the helical antenna is wound on the coil bobbin and is connected to the conductive sleeve. The dielectric cap covers the coil bobbin, the helical coil, and the top end portion of the conductive sleeve together by, for example, the plastic molding to form the antenna top.

In the above, the conductive sleeve and the top end of the conductive rod of the whip antenna are fixed to the dielectric joint member by the insulation molding of the dielectric joint member when the conductive sleeve and the top end of the conductive rod are inserted into a mold.

In any one of the non-separate type antenna assembly and the separate type antenna assembly, it is essential that each of the holder, the conductive sleeve, and the stopper is electrically conductive. Generally, these conductive portions (namely, the holder, the conductive sleeve, and the stopper) are formed by the use of brass or zinc because of availability, machinability, and platability. As the mobile telephone terminal set becomes smaller in size and lighter in weight, the antenna assembly is also required to be light in size.

However, brass or zinc used as a material of each of the conductive portions of the antenna assembly has a large specific gravity. For example, 70–30 brass has a specific gravity of 8.6 g/cm$^2$ and zinc has a specific gravity of 7.18 g/cm$^2$. This makes it difficult to achieve a light weight.

SUMMARY OF THE INVENTION:

It is therefore an object of this invention to provide an antenna assembly which can be lightened in weight.

It is another object of this invention to provide an antenna assembly of the type described, which can be lowered in cost.

It is still another object of this invention to provide an antenna assembly of the type described, which can be increased in strength against external force.

Other objects of this invention will become clear as the description proceeds.

An antenna assembly to which a first aspect of this invention is applicable comprises a whip antenna provided with a stopper of a conductive material at a lower end of the whip antenna, a helical antenna provided with a conductive sleeve mounted on a top end of the whip antenna, and a holder of a conductive material for slidably holding the whip antenna. The holder is electrically connected to the stopper when the whip antenna is in an extended position. The holder is electrically connected to the conductive sleeve when the whip antenna is in a retracted position.

According to the first aspect of this invention, each of the stopper, the conductive sleeve, and the holder is of a light metal having a specific gravity not greater than 3 g/cm$^3$.

An antenna assembly to which a second aspect of this invention is applicable comprises a whip antenna provided with a stopper of a conductive material at a lower end of the whip antenna, a dielectric joint member mounted on a top end of the whip antenna, an antenna top mounted on the dielectric joint member and including a helical antenna and a conductive sleeve connected to the helical antenna, and a holder of a conductive material for slidably holding the whip antenna. The holder is electrically connected to the stopper when the whip antenna is in an extended position. The holder is electrically connected to the conductive sleeve when the whip antenna is in a retracted position.

According to the second aspect of this invention, the dielectric joint member is formed by dielectric resin.

DESCRIPTION OF THE PREFERRED EMBODIMENTS

Figure 1:
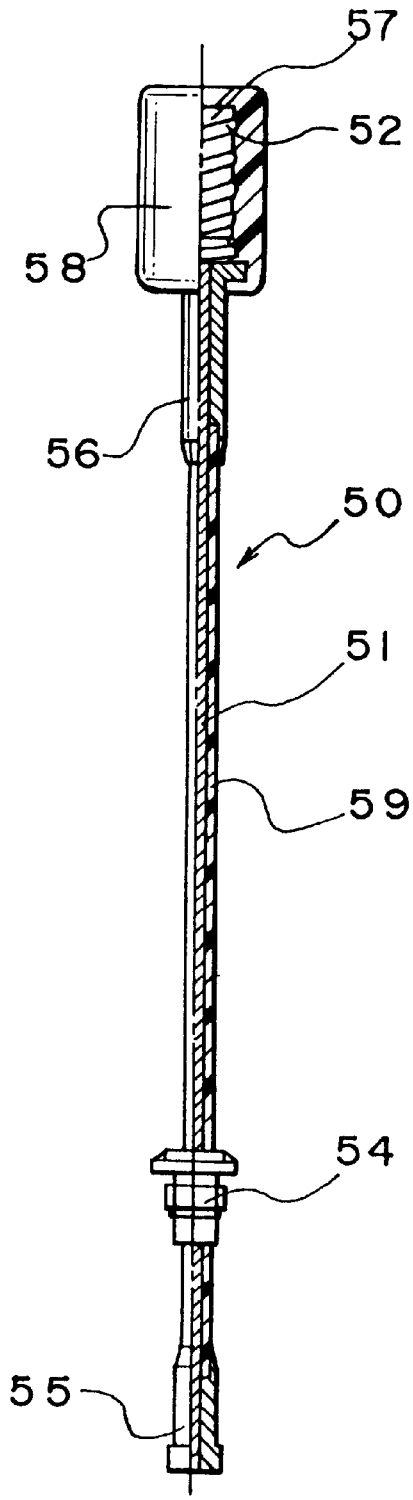
FIG. 1 PRIOR ART
FIG. 1 is a half-sectional view of a conventional non-separate type antenna assembly.
Figure 2:
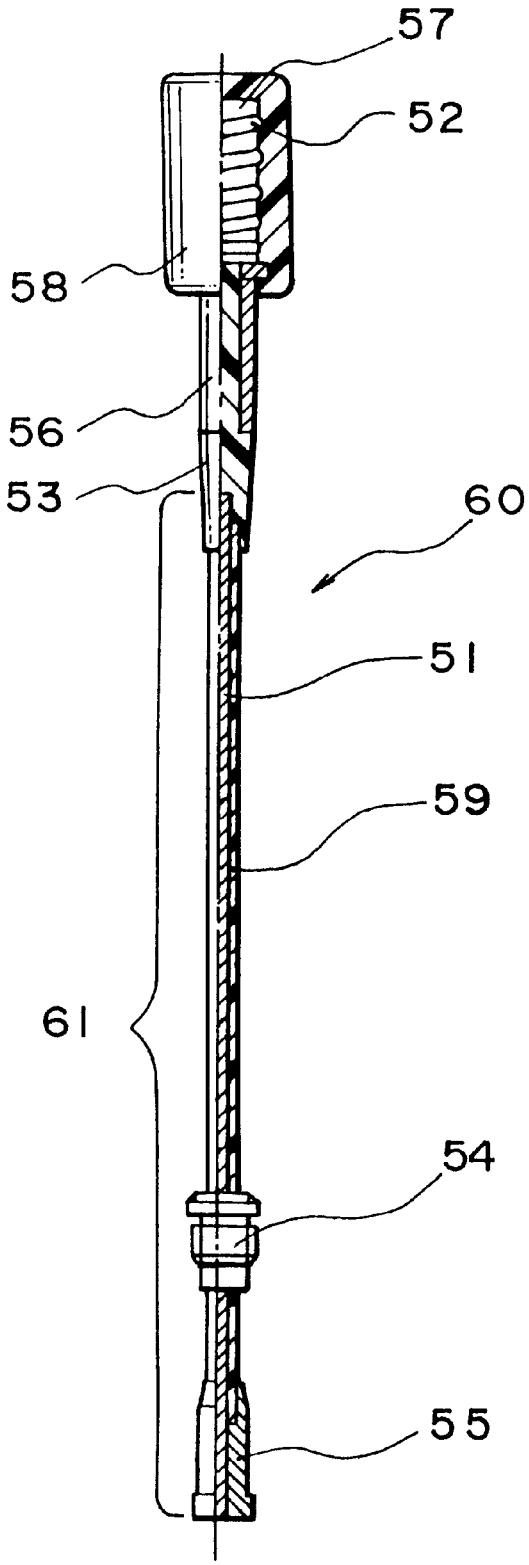
FIG. 2 PRIOR ART
FIG. 2 is a half-sectional view of a conventional separate type antenna assembly.

Referring to FIGS. 1 and 2, conventional antenna assemblies will be described for a better understanding of this invention.

In FIG. 1, a conventional antenna assembly 50 is illustrated which is a non-separate type antenna assembly. The antenna assembly 50 includes a whip antenna having a conductive rod 51 covered with a dielectric tube 59. The antenna assembly 50 further includes a holder 54 attached to a housing of a radio communication device for slidably holding the whip antenna. The holder 54 is made of a conductor and is connected to an electrical circuitry of the radio communication device. The whip antenna is provided with a stopper 55 fixedly mounted on a lower or an inner end of the conductive rod 51 of the whip antenna. When the whip antenna is in an extended position, the stopper 55 is brought into contact with the holder 54 so that the whip antenna is connected to the electrical circuitry through the stopper 55 and the holder 54.

A helical antenna (or a helical coil) 52 is enclosed in a dielectric cap 58 with the helical antenna (or a helical coil) 52 wound on a coil bobbin 57 and is carried on a top end of the whip antenna. The dielectric cap 58 is provided with a conductive sleeve 56 at a lower end electrically connected to the helical antenna 52. The conductive sleeve 56 is fitted onto the top end of the whip antenna and fixed thereto. The helical antenna 52 is connected to the conductive rod 51 of the whip antenna. When the antenna assembly is in a retracted position where the whip antenna is retracted in the housing, the helical antenna 52 is connected to the electrical circuitry through the conductive sleeve 56 and the holder 54.

In FIG. 2, another conventional antenna assembly 60 is illustrated which is a separate type antenna assembly. The antenna assembly 60 is similar to the non-separate type antenna assembly of FIG. 1 except that a dielectric joint member 53 is formed between the conductive sleeve 56 and the top end of a whip antenna 61 which includes the conductive rod 51, the dielectric tube 59, the stopper 55, and the holder 54. The conductive rod 51 of the whip antenna 61 is electrically separated from the helical antenna 52 by the dielectric joint member 53.

In each of the antenna assemblies 50 and 60, it is essential that each of the holder 54, the conductive sleeve 56, and the stopper 55 is electrically conductive. Generally, these portions 54, 56, and 55 are formed by the use of brass easy in cutting or zinc easy in die-casting.

With these materials of brass or zinc typically used, however, restriction is imposed upon achievement of a light weight required in a portable mobile telephone terminal set because free-cutting brass has a specific gravity of 8.6 g/cm$^3$ and zinc has a specific gravity of 7.18 g/cm$^3$.

Furthermore, cutting or die-casting is required in each of the antenna assemblies 50 and 60. Disadvantageously, this results in a relatively high cost.

The antenna assembly 60 of the separate type is weak a in strength at a boundary between the conductive sleeve 56 and the dielectric joint member 53 and easily broken under external force.

Figure 3:
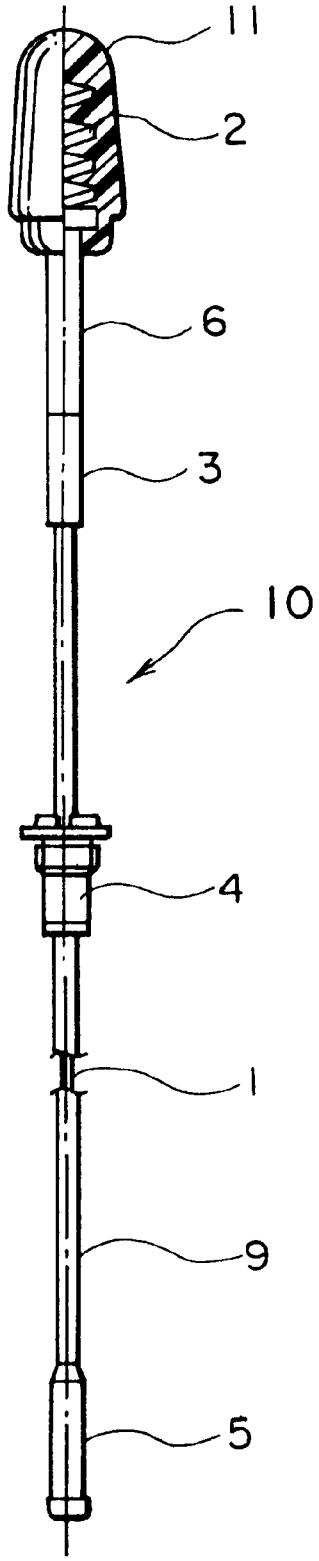
FIG. 3 is a half-sectional view of a separate type antenna assembly according to a first embodiment of this invention.

Referring to FIG. 3, description will proceed to an antenna assenbly according to a first embodiment of this invention. The antenna assembly 10 is a separate type antenna assembly. The antenna assembly 10 includes a whip antenna having a conductive rod 1 covered with a dielectric tube 9. The antenna assembly 10 further includes a holder 4 attached to a housing of a radio communication device for slidably holding the whip antenna. The holder 4 is made of a conductor and is connected to an electrical circuitry of the radio communication device. The whip antenna is provided with a stopper 5 fixedly mounted on a lower or an inner end of the conductive rod 1 of the whip antenna. When the whip antenna is in an extended position, the stopper 5 is brought into contact with the holder 4 so that the whip antenna is connected to the electrical circuitry through the stopper 5 and the holder 4.

A helical antenna (or a helical coil) 2 is enclosed in a dielectric cap 11 and is carried on a top end of the whip antenna. The dielectric cap 11 is provided with a conductive sleeve 6 at a lower end electrically connected to the helical antenna 2. The helical antenna 2 is connected to the conductive rod 1 of the whip antenna through the conductive sleeve 6. A dielectric joint member 3 is formed between the conductive sleeve 6 and the top end of the whip antenna which includes the conductive rod 1, the dielectric tube 9, the stopper 5, and the holder 4. The conductive rod 1 of the whip antenna is electrically separated from the helical antenna by the dielectric joint member 3. When the antenna assembly is in a retracted position where the whip antenna is retracted in the housing, the conductive sleeve 6 is brought into contact with the holder 4 so that the helical antenna 2 is connected to the electrical circuitry through the conductive sleeve 6 and the holder 4.

The above-mentioned configuration is similar to that of the conventional antenna assembly 60 (FIG. 2). However, the antenna assembly 10 according to the first embodiment of this invention is different from the conventional antenna assembly 60 in that each of the stopper 5, the conductive sleeve 6, and the holder 4 is formed by a light metal having a specific gravity not greater than 3 g/cm$^3$.

In the non-separate type antenna assembly, each of the stopper, the conductive sleeve, and the holder may be formed by a light metal having a specific gravity not greater than 3 g/cm$^3$ like in the separate type antenna assembly 10.

Preferably, the light metal contains at lest one of aluminum (having a specific gravity 2.69 g/cm$^3$) and magnesium (having a specific gravity 1.74 g/cm$^3$). For example, the light metal essentially consists of 0.4% or less Si, 0.7% or less Fe, 5.0–6.0% Cu, 0.30% or less Zn, 0.2–0.6% Bi, 0.2–0.6% Pb, and the balance Al. In this invention, an Au—Cu alloy A2011 can be used as the light metal having the above-mentioned composition. Besides, a free-cutting alloy such as A2017 may be used. Thus, the light metal is not restricted to A2011 as far as its composition falls within the above-mentioned range.

The light metal may be a formable material. More specifically, the light metal may be formed by at least one machining process selected from cutting, casting, injection molding, and sintering.

A surface of the light metal may be subjected to zincate treatment followed by electroless Ni plating to a thickness of 7 $\mu$m or less. After the electroless Ni plating, the the light metal may be coated with an electrolytic nickel film and subjected to nickel sulfamate treatment, followed by black Cr plating to a thickness between 1 and 3 $\mu$m.

Remaining conductive portion except the stopper 5, the conductive sleeve 6, and the holder 4 may be formed by the use of a material having a small specific gravity.

Next, description will be made about a specific example of a method of manufacturing the antenna 10 illustrated in FIG. 3.

The three components, i.e. the stopper 5, the conductive sleeve 6, and the holder 4 illustrated in FIG. 3 were prepared by the use of aluminum. Herein, an Al—Cu alloy A2001 was used as aluminum. The alloy A2001 has a tensile strength of 420 MPa which is comparable to the tensile strength of 422 MPa of a free-cutting brass C3560 used in the conventional antenna. Therefore, it is believed that no mechanical problem occurs.

In order to improve corrosion resistance and wear resistance, the surface of each of these aluminum components was plated in the following manner. At first, the surface of the material was subjected to Zn replacement (zincate treatment) and then to electroless Ni plating to a thickness of 7 $\mu$m or less, followed by Ni electrolytic plating on the order of 5 $\mu$m to obtain an Ni film. Subsequently, for the holder 8 and the sleeve 4, the Ni film is further treated by a nickel sulfamate solution and then subjected to black Cr plating to a thickness between 1 and 3 $\mu$m. Thus, products were obtained.

For comparison, a holder 4, a stopper 5, and a sleeve 6 similar in shape to those illustrated in FIG. 3 were prepared by the use of the above-mentioned brass.

The components according to the first embodiment of this invention and the conventional products were measured and compared. As a result, an average weight was equal to 4.12 g (the number of measured samples n=10) for the conventional products. For the products of this invention, the average weight was equal to 2.53 g (n=10). Thus, as compared with the conventional products, the weight could be reduced to about 61%.

This brings about the reduction in weight of the antenna, which in turn contributes to the lightweight structure of a whole of the mobile telephone terminal set.

Figure 4:
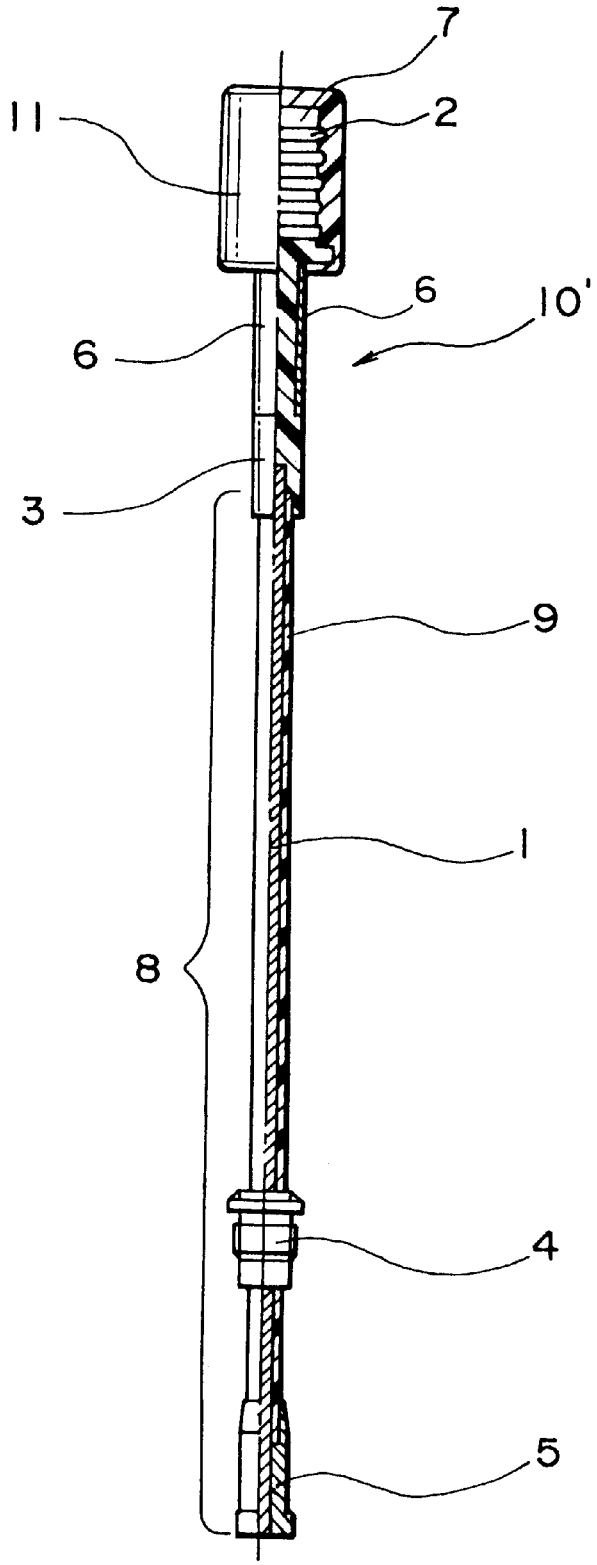
FIG. 4 is a half-sectional view of a separate type antenna assembly according to a second embodiment of this invention.

Turing to FIG. 4, an antenna assembly 10' according to a second embodiment of this invention comprises similar parts designated by like reference numerals. The antenna assembly 10' comprises the helical coil 2 wound on a coil bobbin 7 of dielectric (or insulating) resin. Likewise, the dielectric cap 11 is also of dielectric resin. An antenna top which includes the helical coil 2, the coil bobbin 7, and the dielectric cap 11 is formed by molding with the dielectric resin. The conductive sleeve 6 is of a thin film formed on the dielectric joint member 3 of dielectric resin by the use of plating or coating process. The tube 9 of the whip antenna 8 is also of dielectric resin. In the illustrated antenna assembly, the whip antenna 8 and the helical antenna 2 are insulated within the dielectric joint member 3 with an interval of several millimeters left therebetween and do not simultaneously act as the antennas. This is a so-called extended/retracted state separate antenna.

The dielectric resin of each of the coil bobbin 7, the dielectric cap 11, the dielectric joint member 3, and the tube 9 comprises a macromolecular compound. The macromolecular compound comprises at least one selected from ABS (acrylonitrile butadiene styrene) polymer, PPS (polyphenylene sulfide), nylon, and polybutyrene terephthalate.

The the conductive sleeve 6 is of the thin film 6 comprising at least one selected from Ni, Cr, black chromium, Sn, solder, Cu, Ag, and Au.

Preferably, the dielectric joint member 3 substantially comprises nylon excellent in high-strength insulation and bend durability and is integrally formed with the coil bobbin 7.

The top end of the whip antenna 8 is integrally formed with the coil bobbin 7 and the dielectric joint member 3.

Next, description will be made about a method of manufacturing the antenna assembly 10' according to the second embodiment of this invention.

Figure 5:
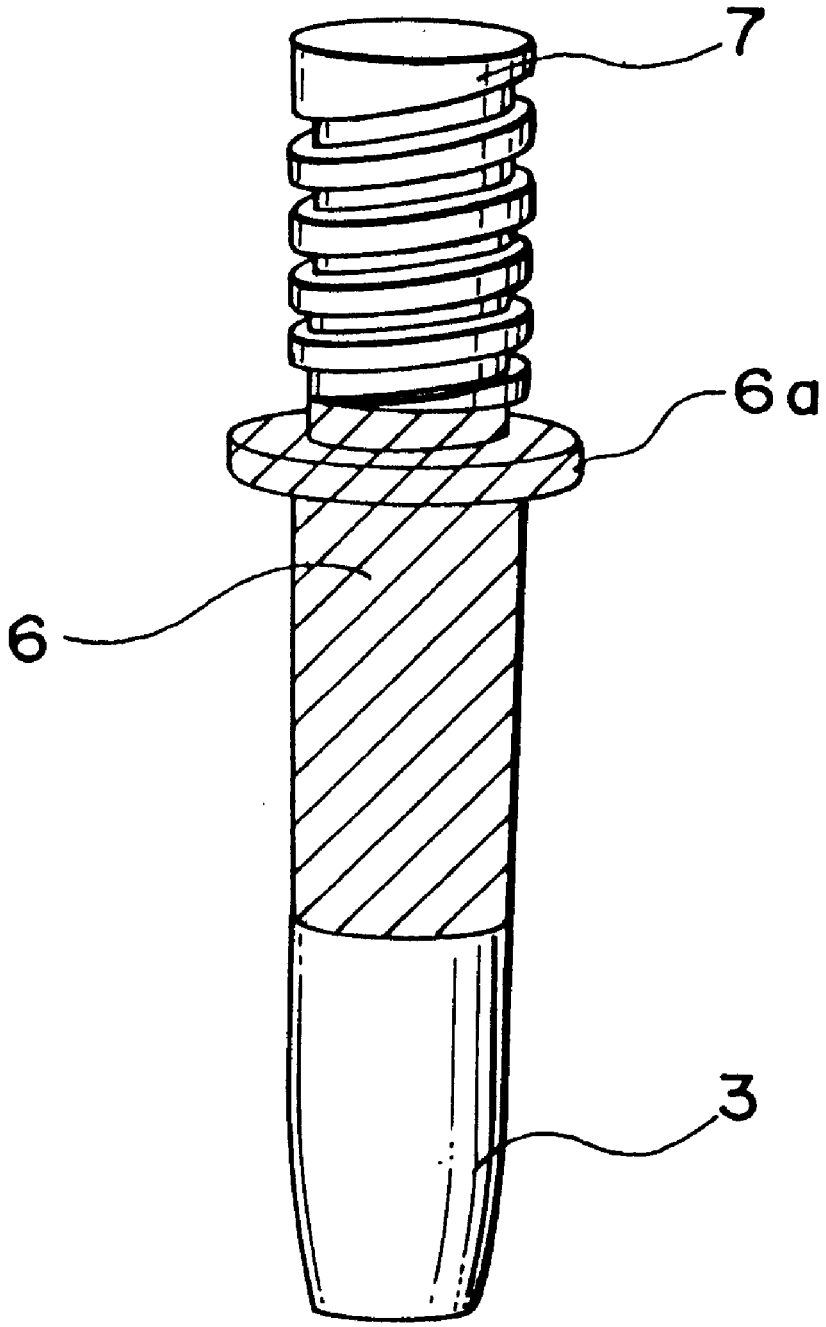
FIG. 5 is a perspective view of a part of the separate type antenna assembly illustrated in FIG. 4.

FIG. 5 is a perspective view of a characteristic part of the antenna assembly 10' illustrated in FIG. 4. As shown in FIG. 5, a combination of the dielectric joint member 3 and the coil bobbin 7 is manufactured by the ABS polymer as a formed product. Subsequently, a predetermined portion of the dielectric joint member 3 and another predetermined portion of the coil bobbin 7 are subjected to chromium plating to form the conductive sleeve 6 and **6*a*** of the thin film having a thickness of about 2 $\mu$m.

Figure 6:
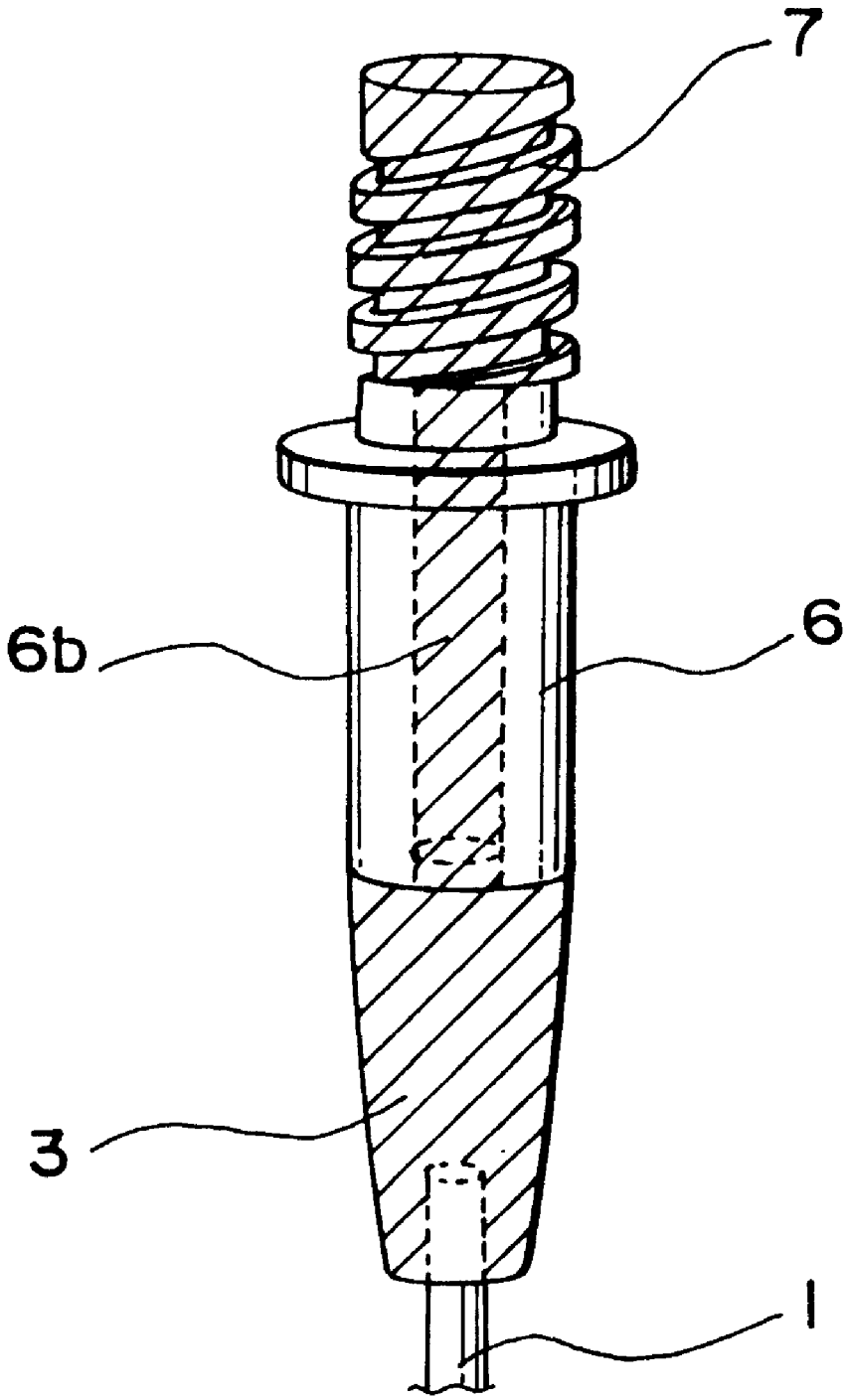
FIG. 6 is a perspective view for use in describing a manufacturing method of the part illustrated in FIG. 5.

Referring to FIG. 6, description will be made about a method of manufacturing the formed product (that is, the combination of the dielectric joint member 3 and the coil bobbin 7) illustrated in FIG. 5. A product is prepared which has a cavity **6*b* formed at its center and having a diameter $\phi$ of 1.9 mm to flow the dielectric resin therethrough. The dielectric joint member 3 and the coil bobbin 7 are formed by the insulation molding when the product and the conductive rod 1 are inserted into a mold. In this event, the dielectric joint member 3 has a gap formed at its lower end and having a depth on the order of 3 mm for insertion of the tube 9 (FIG. 4). The tube 9 is inserted with the conductive rod 1** covered thereby.

With the above-mentioned manufacturing method according to the embodiment of this invention, the antenna can be lightened in weight to about 2.5 g or less as compared with about 4.5 g of the conventional antenna in which the conductive sleeve, the stopper, and the holder are formed by free-cutting brass. Since each component is prepared by forming, the components as many as about twice can be prepared within a same time period. In addition, the present method contributes to the reduction in cost.

Figure 7:
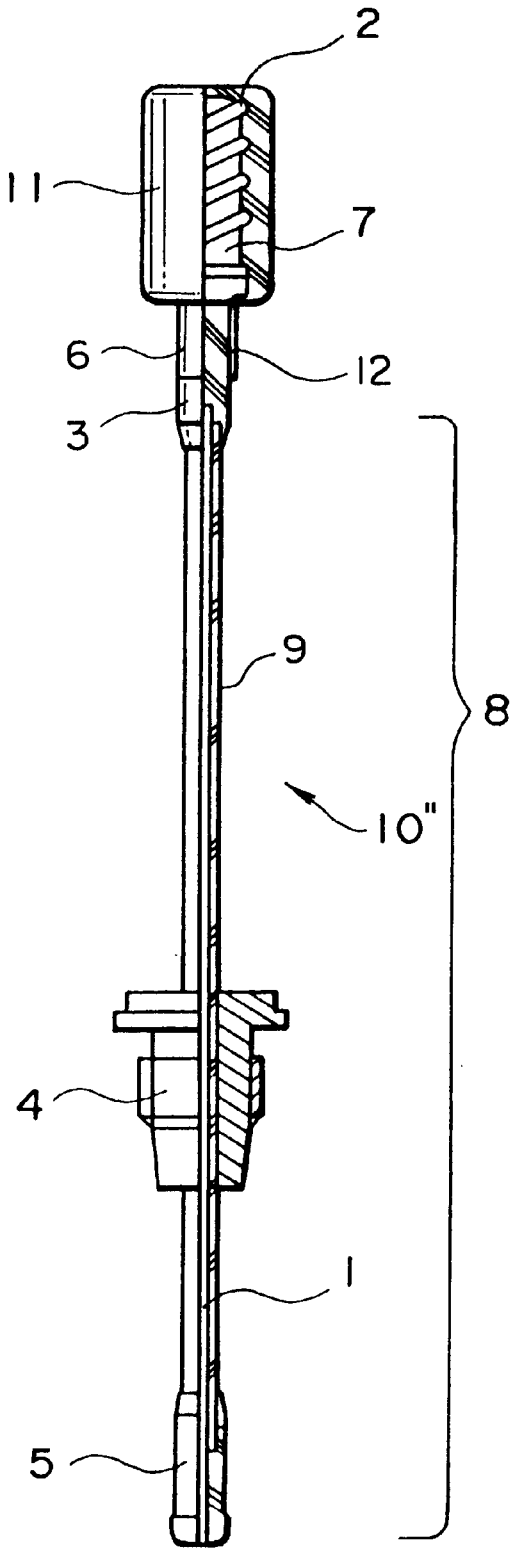
FIG. 7 is a half-sectional view of a separate type antenna assembly according to a third embodiment of this invention.

Turning to FIG. 7, an antenna assembly 10" according to a third embodiment of this invention comprises similar parts designated by like reference numerals. In the antenna assembly 10", the coil bobbin 7 and the dielectric cap 11 are integrally formed with the dielectric joint member 3. Like in the antenna assembly 10' of FIG. 4, the conductive sleeve 6 of a thin conductive film 12 is formed on the dielectric joint member 3 by the use of plating or coating process.

Figure 8:
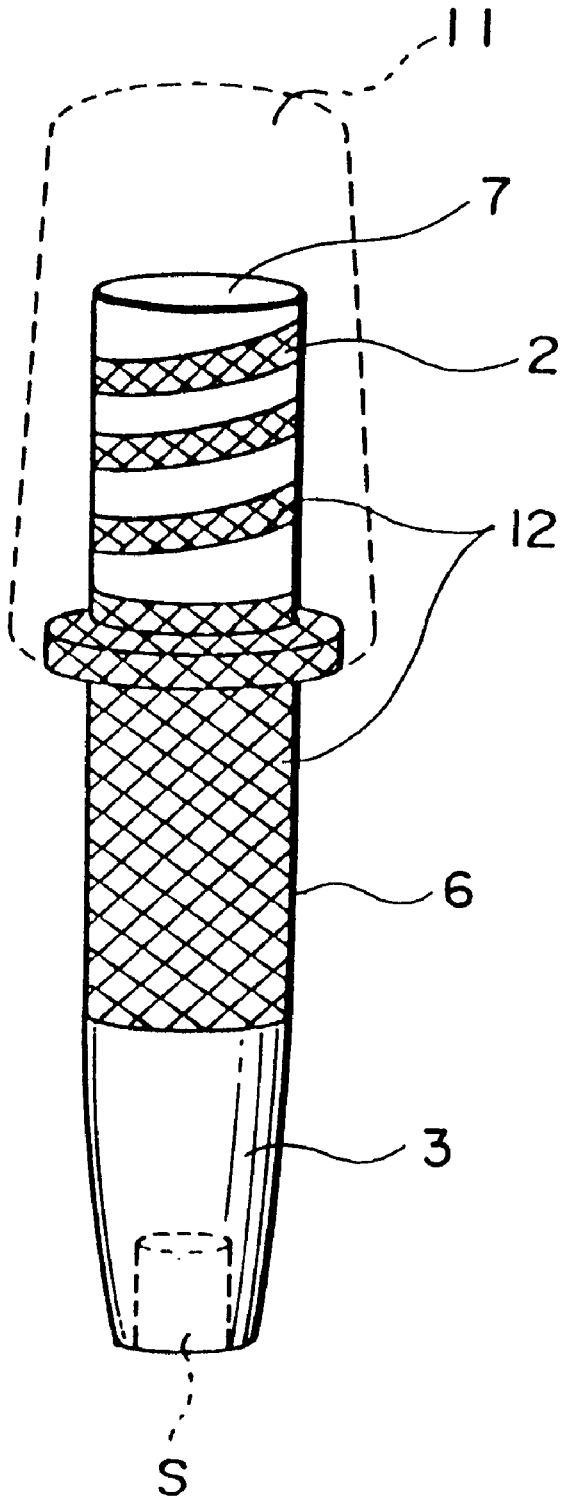
FIG. 8 is a perspective view of a part of the separate type antenna assembly illustrated in FIG. 7.

FIG. 8 is a characteristic part of the antenna assembly 10" illustrated in FIG. 7. As shown in FIG. 8, the helical antenna 2 is also of a thin conductive film 12 formed on the coil bobbin 7 by the use of plating or coating process.

In FIG. 8, the dielectric joint member 3 and the coil bobbin 7 are integrally formed as a formed product by dielectric resin, specifically, by nylon and ABS polymer in the illustrated example. Subsequently, a predetermined portion of the dielectric joint member 3 and another predetermined portion of the coil bobbin 7 are subjected to Ni or Cr plating to form the conductive sleeve 6 and the helical antenna 2 of the thin conductive film 12 having a thickness of about 3 $\mu$m. On forming the thin conductive film 12, use may be made of at least one of black Cr, Sn, solder, Cu, Ag, and Au instead of Ni and Cr. The dielectric cap 11 is formed on the coil bobbin 7 by the dielectric resin.

The dielectric joint member 3 is provided with a gap S formed at its lower end and having a depth on the order of 3 mm so that the tube 9 (FIG. 7) can be inserted.

Figure 9:
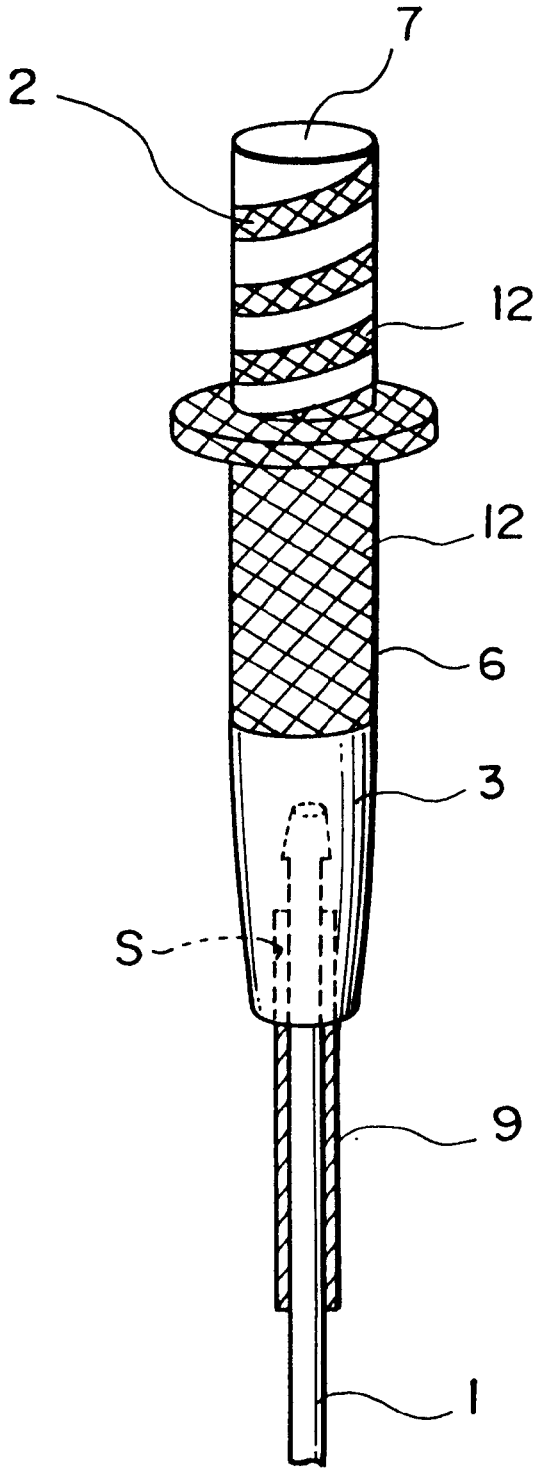
FIG. 9 is a perspective view for use in describing a manufacturing method of the part illustrated in FIG. 8.

Referring to FIG. 9, the tube 9 is inserted with the conductive rod 1 covered thereby.

Figure 10:
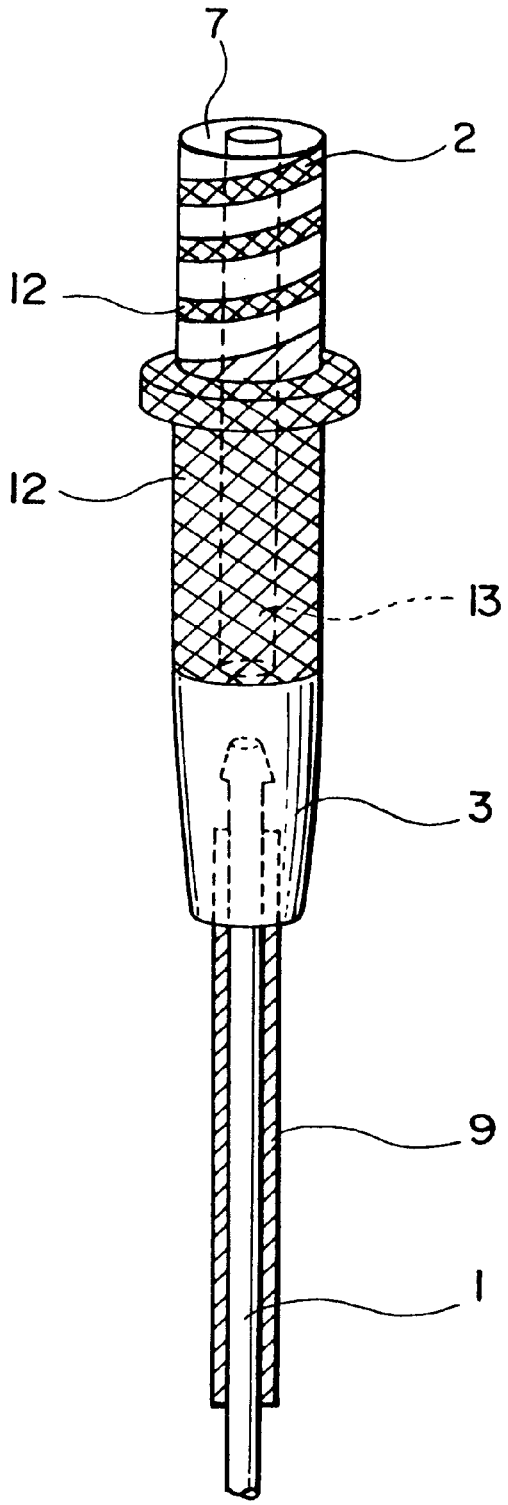
FIG. 10 is a perspective view for use in describing another manufacturing method of the part illustrated in FIG. 8.

Referring to FIG. 10, description will be made about a method of manufacturing the formed product (that is, the combination of the dielectric joint member 3 and the coil bobbin 7) illustrated in FIGS. 8 and 9. A product is prepared which has a cavity 13 formed at its center and having a diameter $\phi$ of 1.9 mm to flow the dielectric resin therethrough. The dielectric joint member 3 and the coil bobbin 7 are formed by the insulation molding when the product and the conductive rod 1 are inserted into a mold. In this event, the dielectric joint member 3 has a gap formed at its lower end and having a depth on the order of 3 mm for insertion of the tube 9. The tube 9 is inserted with the conductive rod 1 covered thereby.

What is claimed is:

1. An antenna assembly movable between an extended position and a retracted position and comprising a whip antenna provided with a stopper of a conductive material at a lower end of said whip antenna, a helical antenna provided with a conductive sleeve mounted on a top end of said whip antenna, and a holder of a conductive material for slidably holding said whip antenna, said holder being electrically connected to said stopper when said whip antenna is in said extended position, and said holder being electrically connected to said conductive sleeve when said whip antenna is in said retracted position, wherein:

each of said stopper, said conductive sleeve, and said holder is made of a light metal having a specific gravity not greater than 3 g/cm$^3$.

2. An antenna assembly as claimed in claim 1, wherein said light metal comprises at least one of aluminum and magnesium.

3. An antenna assembly as claimed in claim 1, wherein said light metal essentially consists of 0.4% or less Si, 0.7% or less Fe, 5.0–6.0% Cu, 0.30% or less Zn, 0.2–0.6% Bi, 0.2–0.6% Pb, and the balance Al in weight.

4. An antenna assembly as claimed in claim 1, wherein a surface of said light metal is subjected to zincate treatment followed by electroless Ni plating to a thickness of 7 $\mu$m or less.

5. An antenna assembly as claimed in claim 4, wherein, after said electroless Ni plating, said light metal is coated with an electrolytic nickel film and subjected to nickel sulfamate treatment, followed by black Cr plating to a thickness between 1 and 3 $\mu$m.

6. An antenna as claimed in claim 1, wherein said light metal is formed by at least one machining process selected from cutting, casting, injection molding, and sintering.

7. An antenna as claimed in claim 1, further comprising a dielectric joint member mounted on the top end of said whip antenna and fixed to said conductive sleeve so that said whip antenna is electrically separated from said helical antenna.

8. An antenna assembly as claimed in claim 1, further comprising a dielectric joint member mounted on a top end of said whip antenna and an antenna top mounted on said dielectric joint member and including said helical antenna and said conductive sleeve connected to said helical antenna wherein:

said dielectric joint member is formed by dielectric resin.

9. An antenna assembly as claimed in claim 8, wherein said dielectric resin comprises a macromolecular compound.

10. An antenna assembly as claimed in claim 9, wherein said macromolecular compound comprises at least one selected from ABS (acrylonitrile butadiene styrene) polymer, PPS (polyphenylene sulfide), nylon, and polybutyrene terephthalate.

11. An antenna assembly as claimed in claim 8, wherein said conductive sleeve is of a thin conductive film formed on a predetermined portion of said dielectric joint member by the use of plating or coating process.

12. An antenna assembly as claimed in claim 11, wherein said thin conductive film comprises at least one selected from the group consisting of Ni, Cr, black chromium, Sn, solder, Cu, Ag, and Au.

13. An antenna assembly as claimed in claim 12, wherein said light metal essentially consists of 0.4% or less Si, 0.7% or less Fe, 5.0–6.0% Cu, 0.30% or less Zn, 0.2–0.6% Bi, 0.2–0.6% Pb, and the balance Al in weight.

14. An antenna assembly as claimed in claim 11, wherein said thin conductive film is electrically separated from said whip antenna and is connected to said helical antenna.

15. An antenna assembly as claimed in claim 14, said antenna top further comprising a coil bobbin on which said helical antenna wound, wherein said coil bobbin is also formed by said dielectric resin, said dielectric joint member being integrally formed with said coil bobbin.

16. An antenna assembly as claimed in claim 14, wherein said helical antenna is of a thin conductive film formed on said coil bobbin of a rod shape by the use of plating or coating process.

17. An antenna assembly as claimed in claim 16, wherein the helical antenna of said thin conductive film comprises at least one selected from the group consisting of Ni, Cr, black chromium, Sn, solder, Cu, Ag, and Au.

18. An antenna assembly as claimed in claim 15, said antenna top further comprising a dielectric cap which covers said helical antenna wound on said coil bobbin, wherein said dielectric cap is also formed by said dielectric resin, said dielectric joint member being integrally formed with said coil bobbin and said dielectric cap.

* * * * *